United States Patent [19]

Christopher

[11] 4,019,353

[45] Apr. 26, 1977

[54] KEEPER LOCK FOR A SLIDE FASTENER

[75] Inventor: Walter S. Christopher, Park Ridge, Ill.

[73] Assignee: Chicago Lock Co., Chicago, Ill.

[22] Filed: May 15, 1975

[21] Appl. No.: 577,655

[52] U.S. Cl. ..... 70/68

[51] Int. Cl.[2] ..... E05B 67/38

[58] Field of Search ..... 70/67–76, 70/162, 216, DIG. 27; 24/205.11 L

[56] References Cited

UNITED STATES PATENTS

| | | | |
|---|---|---|---|
| 1,654,149 | 12/1927 | Teich | 70/216 |
| 1,909,393 | 5/1933 | Diesel | 70/216 X |
| 3,070,986 | 1/1963 | Hart | 70/68 |
| 3,580,016 | 5/1971 | Kerr | 70/68 |
| 3,785,185 | 1/1974 | Kerr | 70/68 |

*Primary Examiner*—Robert L. Wolfe
*Attorney, Agent, or Firm*—Norman H. Gerlach

[57] ABSTRACT

A key-operated keeper lock for a slide fastener includes an outer tubular barrel, an anvil projecting radially from the barrel and adapted for supporting a fastener lacing element thereon, a tubular handle rotatable in the barrel, means securing the handle against substantial axial movement relative to the barrel, a keeper arm fixed to and projecting radially from the handle for rotation therewith and adapted to overlie the anvil and a fastener lacing element thereon for retaining the lacing element between the keeper arm and the anvil to prevent operation of the fastener, a lock cylinder rotatable in the handle, tumbler means movable between the lock cylinder and the handle for alternately preventing and enabling rotation of the lock cylinder relative to the handle, a lock bolt mounted in the handle and movable when the keeper arm overlies the anvil between a position locking the handle to the barrel and an unlocking position freeing the barrel for rotation, and means coupling the lock cylinder and the lock bolt for moving the bolt between its said positions in response to rotation of the lock cylinder, said handle and said keeper arm being adapted upon movement of the lock bolt to its unlocking position to rotate between the position of the keeper arm overlying the anvil and an out-of-the-way position wherein the lacing element is accessible for manipulation, while each remains substantially in a constant axial disposition relative to the barrel.

4 Claims, 14 Drawing Figures

KEEPER LOCK FOR A SLIDE FASTENER

BACKGROUND OF THE INVENTION

This invention relates to a keeper lock for a zipper-type slide fastener having a lacing element, and in particular, to a lock of the type disclosed in U.S. Pat. Nos. 3,070,986, 3,580,016 and 3,785,185.

The keeper locks with which the present invention is concerned are constructed for use in connection with the slide fastener of a flexible fabric money bag or other enclosing means or container. The locks serve to retain or trap the lacing element of a slide fastener with the fastener closed, to prevent operation of the fastener and thus prevent unauthorized access to the contents of the bag or other enclosing means.

The keeper locks of the above-identified patents each embody a tubular lock barrel which is fastened to the pouch of a money bag. In U.S. Pat. No. 3,070,986, a lock cylinder rotates in the barrel, and a keeper arm fixed to the cylinder rotates therewith, between slide fastener locking and unlocking positions. One disadvantage of such a structure is that it is relatively susceptible to picking. Another disadvantage of the structure is that it is vulnerable to damage to its tumbler elements when torque is applied to the keeper arm, to the extent of breakage, so that the lock is forced open.

U. S. Pat. Nos. 3,580,016 and 3,785,185 disclose keeper locks which embody improvements on the foregoing structure. The improvements include the provision of an intermediate tubular handle, disposed between the lock barrel and the lock cylinder. In such structure, the keeper arm is affixed to the handle. The locks of the latter patents have a so-called "pop-up" structure, wherein the handle and cylinder are elevated or "pop-up" upon unlocking, and are rotated to an out-of-the-way keeper arm position when elevated. The structure of U.S. Pat. No. 3,070,986 involves no elevation of parts, but the lock of cylinder remains in a constant axial disposition relative to the barrel.

SUMMARY OF THE INVENTION

The present invention serves to combine in one, compact lock structure certain of the advantageous features of the above-identified patents. In particular, the new keeper lock embodies the more rugged and tamper-resistant structure of barrel, handle and cylinder, of the later patents, together with the compact, axially non-shifting parts structure of the earlier patent.

The keeper lock of the invention includes a tubular barrel, an anvil fixed to and projecting radially from the barrel and adapted for supporting a fastener lacing element thereon, a tubular handle rotatable in the barrel, means securing the handle against substantial axial movement relative to the barrel, a keeper arm fixed to and projecting radially from the handle for rotation therewith and adapted to overlie the anvil and a fastener lacing element thereon for retaining the lacing element between the keeper arm and the anvil to prevent operation of the fastener, a lock cylinder rotatable in the handle, tumbler means movable between the lock cylinder and the handle for alternately preventing and enabling rotation of the lock cylinder relative to the handle, a lock bolt mounted in the handle and movable when the keeper arm overlies the anvil between a position locking the handle to the barrel and an unlocking position freeing the handle for rotation, and means coupling the lock cylinder and the lock bolt for moving the bolt between its said positions in response to rotation of the lock cylinder, said handle and said keeper arm being adapted upon movement of the lock bolt to its unlocking position to rotate between said position of the keeper arm overlying the anvil and an out-of-the-way position wherein the lacing element is accessible for manipulation, while each remains substantially in a constant axial disposition relative to the barrel.

In preferred embodiments of the invention, lug and stop means are interposed between the barrel and the handle for limiting the degree of rotation of the keeper arm. The keeper arm preferably is provided with a cam undersurface engageable with a lacing element supported on the anvil to force the element into a retention pocket on the anvil. Access to the interior of the barrel by a tool inserted through the wall of the enclosure in which the lock is mounted is prevented by providing a closure plate for a barrel opening which normally is within the enclosure.

BRIEF DESCRIPTION OF THE DRAWINGS

The attached drawings illustrate a preferred embodiment of the invention, without limitation thereto. In the drawings, like elements are identified by like reference symbols in each of the views, and.

DESCRIPTION OF THE PREFERRED EMBODIMENT

Figure 1:
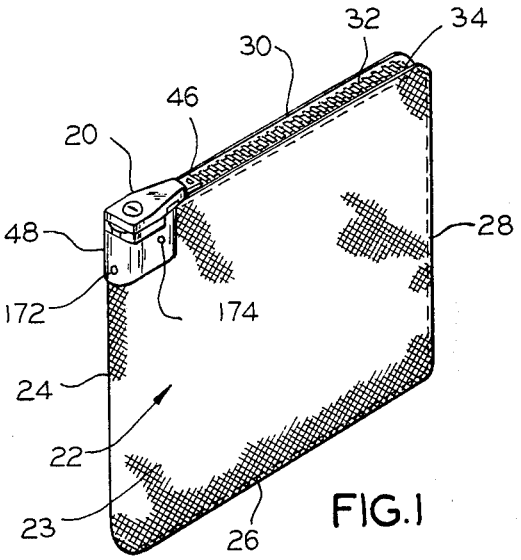
FIG. 1 is a perspective view of a money bag having a slide fastener thereof locked with the keeper lock of the invention, which is mounted on the bag.
Figure 4:
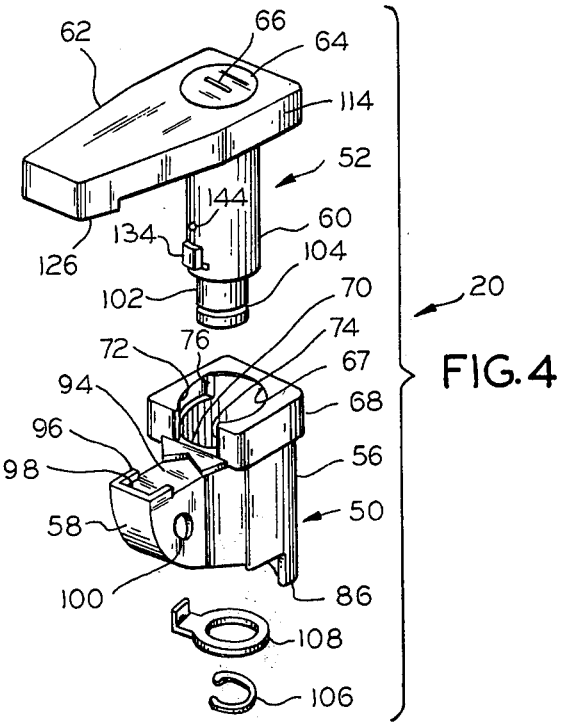
FIG. 4 is a partly exploded perspective view of the lock, on a reduced scale, illustrating the parts oriented in the positions they assume when the lock is in its locking condition.
Figure 2:
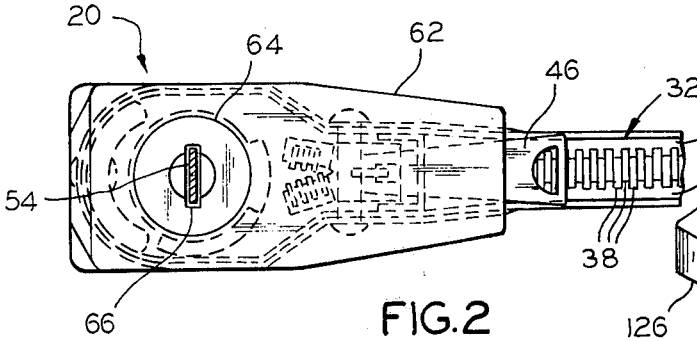
FIG. 2 is an enlarged fragmentary top plan view of the structure illustrated in FIG. 1.
Figure 3:
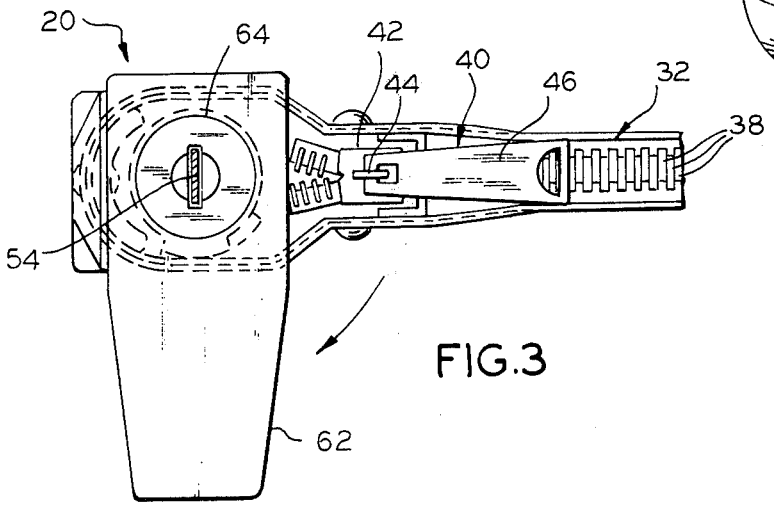
FIG. 3 is a view like FIG. 2 but illustrating the keeper arm of the lock in an out-of-the-way position exposing the lacing element and pull tab of the fastener for manipulation thereof.
Figure 6:
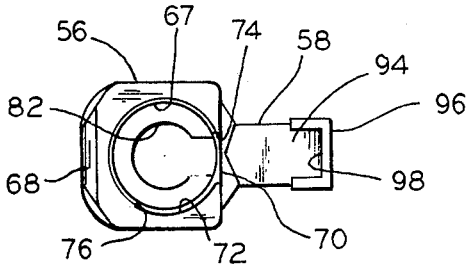
FIGS. 6 and 7 are, respectively, top and bottom plan views of the barrel assembly of the lock.

Referring to FIGS. 1-3 of the drawings, a keeper lock 20 representing a preferred embodiment of the invention is illustrated as it is employed on a money bag 22 or the like. The bag 22 includes a flexible, envelope-like pouch 23 formed of a single generally rectangular sheet of canvas, cloth, duffel or other strong material. The sheet is folded upon itself and the edges thereof are joined together in the usual manner of construction of such a bag, to provide a two-sided pouch 23 having a folded side edge 24, a fully closed bottom edge 26, and a partially closed side edge 28. The top edge 30 and the upper portion of the partially closed side edge 28 remain unclosed, in order to provide an entrance opening which is opened and closed by a conventional zipper-type slide fastener 32 secured to such edges. The partially closed side edge 28 and the upper edge 30 join at a rounded corner 34, and the fastener 32 arches around the corner, thereby affording a wide entrance opening to the bag 22 when the two sides of the bag are spread apart with the fastener open.

The slide fastener 32 includes a pair of cloth attachment or mounting strips 36, which are stitched to the pouch 23. Each of the attachment strips 36 carries a longitudinal series of spaced locking fingers 38. A slide member 40 of conventional construction includes a lacing element 42 having a bail 44 upstanding thereon, and a pull tab 46 pivotally attached to the bail for moving the lacing element thereby. The lacing element 42 is mounted on the attachment strips 36 for sliding movement on the locking fingers 38, with the locking fingers on each strip converging in the lacing element. Movement of the lacing element 42 in one direction serves to bring the locking fingers 38 together in interlocking relation therein, closing the fastener and thereby the opening to the bag 22. Reversal of movement of the lacing element 42 causes the locking fingers 38 of the respective strips to separate from each other, thereby opening the slide fastener and the bag 22. As seen in FIG. 3, the slide fastener 32 terminates a short distance inwardly of the folded side edge 24 of the pouch 23, thus leaving a void at the corresponding corner of the pouch, which serves to receive the keeper lock 20. A reinforcing piece 48 of leather or other suitable material is wrapped around the pouch at that corner.

Referring to FIGS. 4-7, the keeper lock 20 includes a barrel assembly 50 and a plug assembly 52. These assemblies are, in general, similar to corresponding assemblies of U.S. Pat. No. 3,785,185, with certain modifications serving to accomplish the objects of the present invention. The lock is operated by a single-bitted key 54. The barrel assembly 50 includes a tubular barrel or body 56 and an anvil 58 integral therewith and projecting radially therefrom. The plug assembly 52 includes a generally cylindrical tubular handle 60 rotatable in the barrel 56, and a keeper arm 62 integral with the handle 60 and rotating therewith, and projecting radially from the handle. The plug assembly 52 also includes a tumbler-type lock cylinder 64 rotatable in the handle 60. The lock cylinder 64 is provided with an axial keyway 66, which receives the key 54 therein, for operation of the lock tumblers.

The barrel 56 has a cylindrical bore 67 which receives the handle 60. The barrel is surmounted by a laterally outwardly projecting circumferential rim flange 68 having a lug slot 70 extending downwardly therein from the upper surface thereof, adjacent to the anvil 58. An arcuate lug recess 72 is formed in the wall of the barrel bore 67 and bounded by the rim flange 68, in communication with the lug slot 70. The lug slot 70 and the lug recess 72 together provide an arcuate movement path for a lug, subsequently described. The movement path is bounded at one end by a lug stop 74 constituting one boundary of the lug slot 70, and at the other end by a second lug stop 76 constituting a shoulder formed in the wall of the barrel bore 67.

Figure 9:
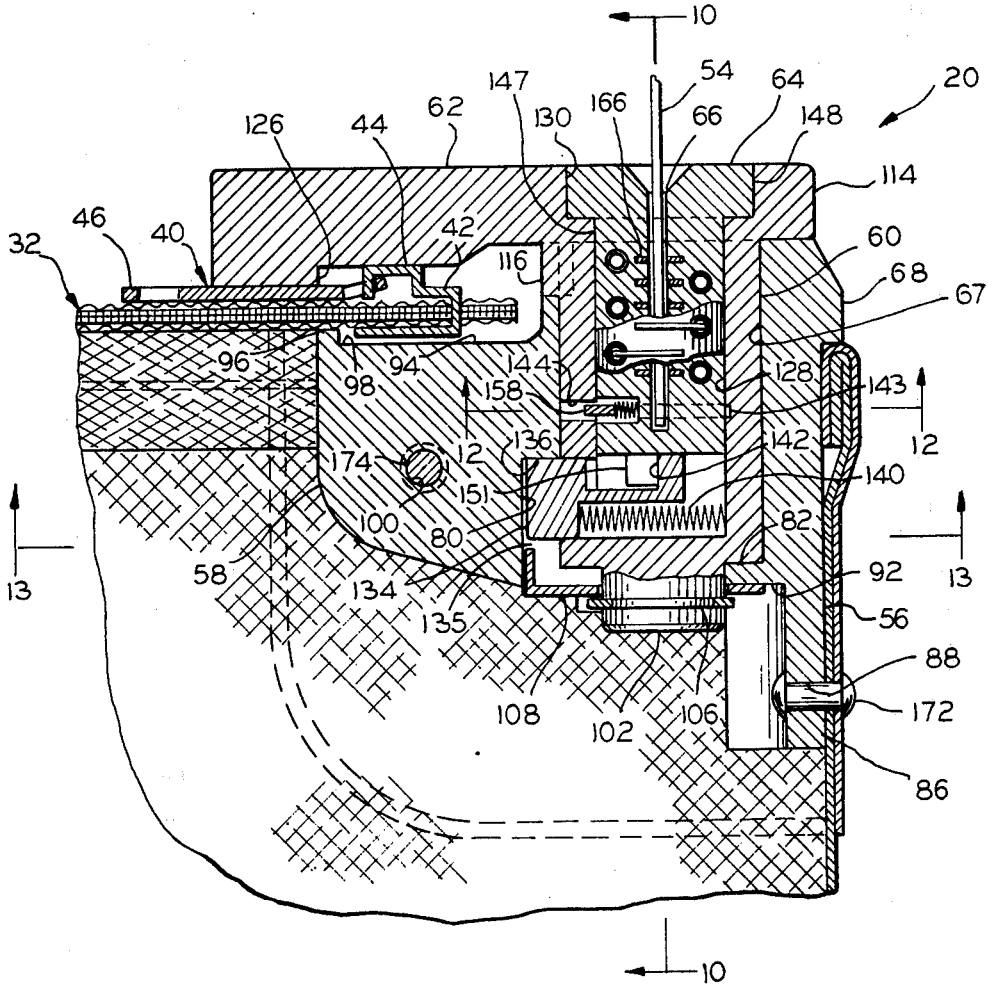
FIG. 9 is an enlarged central longitudinal and vertical sectional view of the lock, illustrating it as mounted on the money bag, shown fragmentarily, with parts of the lock being shown partially in elevation.

A rectangular lock bolt recess 80 is formed in the wall of the bore 67 of the barrel 56, and it extends from the normally lower end of the barrel to a point intermediate the upper and lower ends thereof (see FIG. 9). A C-shaped flange 82 extends inwardly from the wall of the bore 67 at the lower end of the barrel 56, and it terminates at the bolt recess 80. The walls of the recess 80 and the flange 82 together define a keyhole-shaped opening 84 in the lower end of the barrel 56. An arcuate extension 86 projects downwardly from the barrel 56, and the extension is provided with a mounting hole 88 (FIG. 9) extending therethrough. A pair of ridges 90 adjoin the extension 86 on opposite sides of the keyhold opening 84 and define a rounded recessed seat 92 on the underside of the flange 82 around the opening.

A generally rectangular, flat seating surface 94 is provided on top of the anvil 58. The outer end of the seating surface 94 is bounded by an upwardly projecting U-shaped retaining flange 96 which forms a retention pocket 98 with the seating surface. The anvil 58 also is provided with a mounting hole 100 extending transversely therethrough.

Referring particularly to FIGS. 4, 5 and 8-10, the handle 60 has an outer diameter approximating the diameter of the barrel bore 67, for rotation of the handle therein. A reduced diameter cylindrical stem 102 extends from the handle 60 and through the keyhole opening 84 for rotation in the circular portion thereof. A peripheral groove 104 is provided in the stem 102, adjacent to its intersection with the plane of the seat 92 on the lower end of the barrel 56. A split snap ring 106 is mounted in the stem groove 104, and it projects outwardly therefrom for preventing movement of the stem through the keyhole opening 84, thereby securing the handle 60 against the substantial axial movement relative to the barrel 56.

Figure 11:
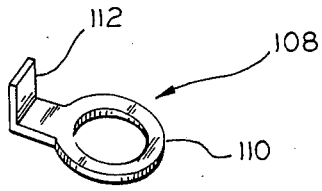
FIG. 11 is a perspective view of a closure plate employed in the lock.
Figure 12:
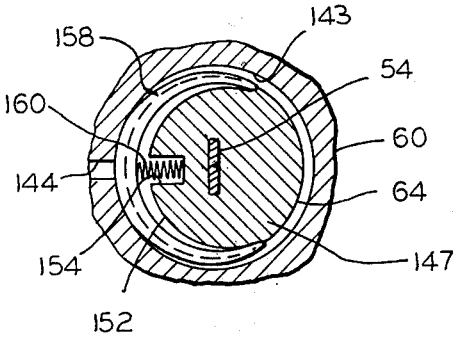
FIGS. 12 and 13 are further enlarged fragmentary horizontal sectional views of the lock, taken respectively on lines 12—12 and 13—13 of FIG. 9.
Figure 13:
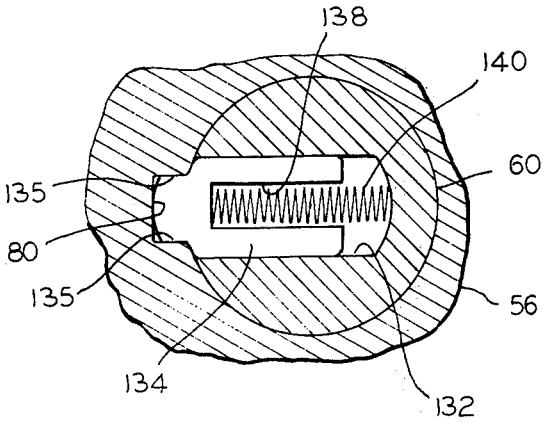
Figure 14:
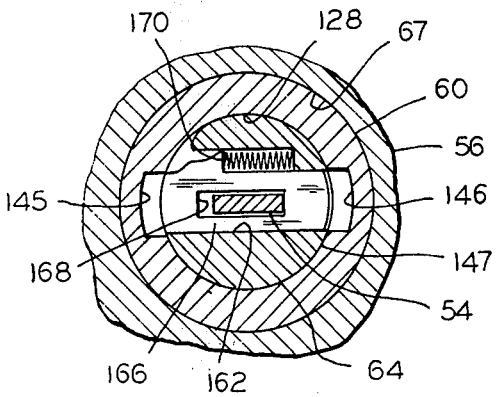
FIG. 14 is a further enlarged fragmentary horizontal sectional view of the lock, taken on line 14—14 of FIG. 10.

A closure plate 108 (see also FIG. 11) is disposed between the projecting snap ring 106 and the C-shaped flange 82 and is held in place thereby. The closure plate 108 includes a washer portion 110 through which the stem 102 extends and which is held against the seat 92, and an angle portion 112 which extends over and into the lock bolt recess 80, thereby completely closing the keyhole opening 84. The resulting closure is designed to prevent entrance of a picking tool or the like into the lock bolt recess 80 for the purpose of shifting the lock bolt, subsequently described, into its unlocked position. The tool might be inserted through the pouch 23 in an attempt to pick the lock.

The keeper arm 62 is integral with or fixed to the handle 60 at the normally upper end thereof, and by virtue of increased dimensions, it provides a flange 114 extending laterally outwardly from the handle 60. The keeper arm flange 114 overlies the rim flange 68 on the barrel 56, to prevent access to the cylindrical interface between the barrel and the handle 60. A lug or spline 116 is integral with the undersurface of the keeper arm flange 114, extending downwardly therefrom, and with the outer surface of the handle 60, extending radially outwardly therefrom. The lug 116 is received in the lug slot 70 in the barrel rim flange 68. Upon rotation of the plug assembly 52, the lug 116 is received in the lug recess 72. The lug travels in the movement path provided by the slot 70 and the adjoining recess 72. The lug stops 74 and 76 limit movement of the lug 116, and thus also movement of the handle 60 and the keeper arm 62, to an angle of about 90 degrees in the preferred illustrative embodiment. The keeper arm 62 rotates between a slide member-retaining position overlying the anvil 58 and an out-of-the-way position to one side of the anvil and rotated approximately 90° from the retaining position.

Figure 8:
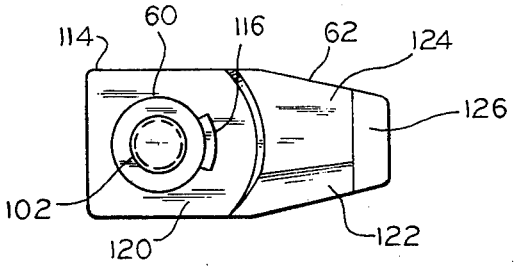
FIG. 8 is a bottom plan view of the plug assembly of the lock, with the lock bolt drawn into the assembly.
Figure 7:
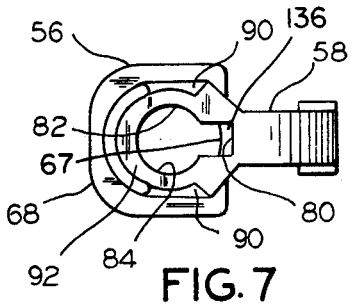

Referring especially to FIG. 8, the undersurface 120 of the keeper arm 62 is provided with an inwardly and outwardly or downwardly inclined, generally flat cam surface 122 intersecting a protruding generally flat, horizontal bearing surface 124 intermediate the ends of the arm 62. The keeper arm 62 also includes a transversely extending rib or boss 126 at the far end of the arm and adjacent to the cam and bearing surfaces 122 and 124. The keeper arm 62 and the rib 126 thereof extend beyond the retaining flange 96 on the anvil 58 when the keeper arm 62 is positioned over the anvil, as illustrated in FIG. 9. The cam and bearing surfaces 122 and 124 engage the bail 44 of a slide fastener 32, and the rib 126 engages the pull tab 46 thereof, as described hereinafter. The foregoing structure of the keeper arm 62 previously has been employed in a keeper lock similar to that of U.S. Pat. No. 3,070,986.

Referring to FIGS. 9, 10 and 12–14, the handle 60 has a cylindrical bore 128 that extends from a location spaced inwardly from the stem 102, and for the remaining length of the handle into the integral keeper arm 62. A counterbore 130 is provided in the keeper arm 62. A transverse lock bolt race 132 is provided in the bottom of and extending through the side wall of the handle 60, in communication with the handle bore 128. An elongated lock bolt 134 is mounted in the race 132, for slidable transverse movement from a position entirely within the handle 60 to a position in which part of the bolt projects laterally outwardly from the handle. The bolt 134 projects into the bolt recess 80 in the barrel 56, for locking the handle to the barrel. The bolt 134 engages the side walls 135 of the bolt recess 80 and a stop shoulder 136 at the inner end of the bolt recess. The bolt has a bottom groove 138 which receives a coil compression spring 140 therein and between the bolt and the side wall of the handle 60. The bolt 134 also includes a top pin slot 142.

An annular internal groove 143 is provided in the side wall of the handle 60, adjacent to and spaced above the bolt race 132. An access hole 144 extends through the side wall and communicates with the internal groove 143. A pair of diametrically opposed internal tumbler grooves 145 and 146 extend in the axial direction in the side wall of the handle, from the counterbore 130 to a location spaced above the annular groove 143.

Figure 10:
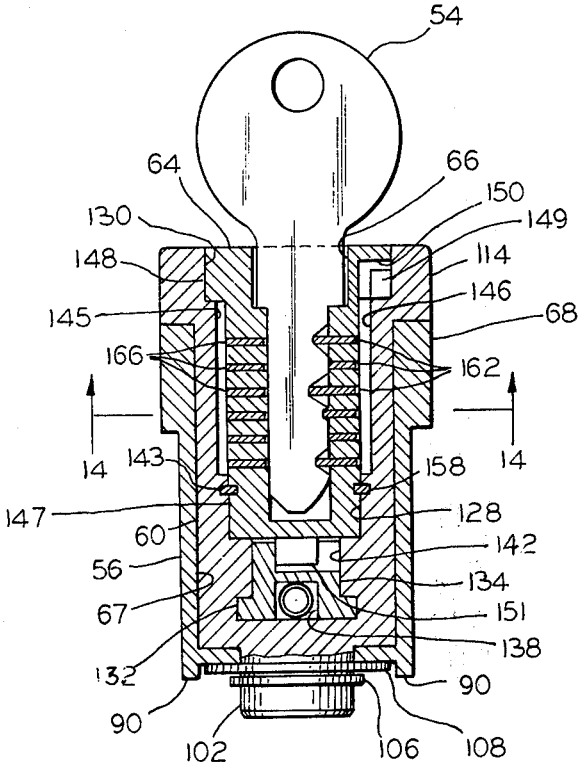
FIG. 10 is an enlarged transverse vertical sectional view of the lock, taken on line 10—10 of FIG. 9.

The lock cylinder 64 is like that of U.S. Pat. No. 3,785,185. It includes a cylindrical body 147 received in the handle bore 128, and an enlarged cylindrical head 148 received in the counterbore 130 in the keeper arm 62. Referring to FIG. 10, a locating and stop lug 149 is integral with the wall of the counterbore 130 in the handle 60, and it is received in a complementary arcuate recess 150 in the cylinder head 148. The lug 149 limits the rotation of the cylinder to an angle of 90 degrees. An eccentric lock pin 151 is integral with the inner end of the body 147 and extends therefrom into the pin slot 142 in the lock bolt 134, for operating the bolt thereby.

An arcuate mounting groove 152 (see especially FIG. 12) is formed around the cylinder body 147, and a radial blind bore 154 in the body 147 communicates with the groove 152. The mounting groove 152 registers or communicates with the annular groove 143 in the wall of the handle 60. A crescent-shaped retaining ring 158 is mounted in the mounting groove 152, and it is urged outwardly into the handle groove 143 by a coil compression spring 160 seated in the blind bore 154. The retaining ring 158 may be depressed and moved into its mounting groove 152 against the spring pressure by a wire or suitable tool inserted through the access hole 144, whereupon the lock cylinder 64 may be withdrawn from the handle 60.

The lock cylinder 64 has a generally conventional tumbler construction. The cylinder body 147 is provided with a series, six in the illustrative embodiment, of transverse tumbler slots 162 that intersect the longitudinal keyway 66, as illustrated most clearly in FIGS. 9, 10 and 14. The tumbler slots 162 register with the tumbler grooves 145 and 146 in the wall of the handle 60. A plate tumbler 166 is mounted in each tumbler slot 162, and it is provided with a key opening 168 registering with the keyway 66. Each tumbler is mounted under the pressure of a coil compression spring 170, which urges the tumbler into one tumbler groove 145 in the handle, to thereby secure the cylinder 64 against rotation in the handle 60. As is well known, when the bitted key 54 is inserted in the keyway 66, the tumblers 166 are withdrawn from the tumbler 145, being drawn into the cylinder body 147, to free the cylinder 64 for rotation in the handle 60. This condition is illustrated in the drawings. The key 54 can be removed when the tumbler slots 162 are aligned with the tumbler grooves 145 and 146, and removal of the key restores the tumblers 166 to their anti-rotational dispositions in the tumbler groove 145.

In use, the keeper lock 20 is mounted on the bag 22, with headed rivets 172 and 174 (FIGS. 1 and 9) extending through the reinforcing piece 48 and the pouch 23. One rivet 172 extends through the mounting hole 88 in the barrel extension 86 and secures the extension to the bag. The other rivet 174 extends through the mounting hole 100 in the anvil 58 and secures the anvil to the bag. The adjacent edges of the pouch 23 and the reinforcing piece 48 are brought up under the rim flange 68 on the barrel 56, and are pulled tightly around the barrel.

Figure 5:
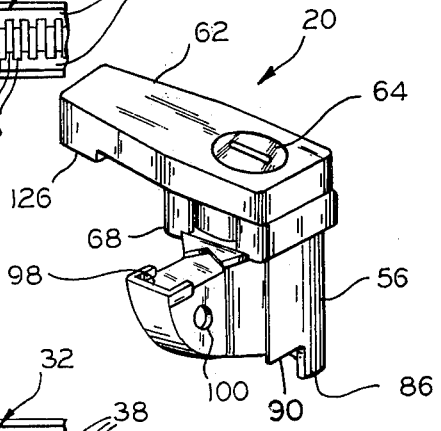
FIG. 5 is a similar perspective view of the lock, with the keeper arm of the lock swung to the out-of-the-way position.

Normally, the plug assembly 52 is in its out-of-the-way position, illustrated in FIGS. 3 and 5, when the slide fastener 32 and the bag 22 are open. It is necessary that the plug assembly be in such a position when it is desired to close and lock the bag, in order to afford access to the top of the anvil 58. In closing the bag, the fastener slide member 40 is pulled up to the lock, by means of its pull tab 46. The lacing element 42 is pulled over the anvil 58, until the element is over the pocket 98 and behind the retaining flange on top of the anvil. The attachment strips 36 with the locking fingers 38 joined together extend over the retaining flange 96 and seat thereon. The pull tab 46 rests on the lacing element 42 and the strips 36 and locking fingers 38 adjacent thereto, and extends outwardly from the retaining flange 96.

To lock the bag 22, the keeper arm 62 is swung or rotated counterclockwise through an angle of 90 degrees from its out-of-the-way position illustrated in FIGS. 3 and 5 to its slide member-retaining position illustrated in FIGS. 1, 2, and 9. In the process of swinging the keeper arm 62 into its retaining position, the cam surface 122 thereon contacts the bail 44 of the slide member 40, and cams it downwardly or inwardly, into the pocket 98. As the movement of the keeper arm 62 is completed, the bail 44 comes into contact with the bearing surface 124 on the arm, which serves to bear on the bail and maintain the lacing element 42 within the pocket 98 and behind and beneath the level of the retaining flange 96, so that the lacing element cannot be pulled out of the pocket. Also, the rib 126 on the end of the keeper arm 62 moves into a position overlying the pull tab 46, and thereafter serves to hold it down, as illustrated in FIG. 9. Consequently, the pull tab 46 cannot be raised for operating the lacing element 42, and the lacing element cannot be removed from the pocket 98, so that the slide fastener 32 is locked effectively, and the bag 22 cannot be opened.

In the locking position, and with the key 54 removed from the lock 20, the lock cylinder 64 cannot be turned in the handle 60, owing to the engagement of the tumblers 166, which extend into one tumbler groove 145 in the handle 60. The cylinder 64 cannot be withdrawn from the handle 60, owing to engagement of the retaining ring 158 with the cylinder and with the handle. The lock bolt 134 projects from the handle 60 into the bolt recess 80 in the barrel 56, thereby serving to lock the two together against rotation of the plug assembly 52. Engagement of the bolt 134 with the stop shoulder 136 on the barrel 56 prevents the plug assembly 52 from being pulled or forced upwardly, out of the bore 67 in the barrel. When the lock subsequently is unlocked, the plug assembly 52 is retained in the bore by means of the snap ring 106 on the stem 102, the ring engaging the closure plate 108 which in turn engages the flange 82 on the barrel 56.

Upon inserting the key 54 into the keyway 66 to unlock the lock 20, the tumblers 166 are moved into the lock cylinder 64 and out of engagement with the handle 60. Accordingly, the cylinder 64 may be rotated by turning the key 54. When the key is turned 90 degrees in the clockwise direction, the eccentric lock pin 151 is moved correspondingly, and it pulls the lock bolt 134 into the handle 60 and out of engagement with the barrel 56. The entire plug assembly 52 then may be manually rotated 90° in the clockwise direction, to the out-of-the-way position illustrated in FIGS. 3 and 5. The slide member 40 of the fastener 32 is thus rendered accessible for manipulation. The pull tab 46 may be grasped and raised somewhat for proper operation, and upon pulling the tab, the lacing element 42 functions to separate the locking fingers 38 and open the mouth of the bag.

The key 54 may be allowed to remain in the lock when the bag 22 is open. Alternatively, the key may be removed. This is accomplished by turning the key in the counterclockwise direction, to restore the lock cylinder 64 to the disposition illustrated in FIG. 10, when the key may be withdrawn. The handle 60 and the keeper arm 62 remain in their positions illustrated in FIGS. 3 and 5, in which the lock bolt 134 (see FIGS. 9 and 13) is out of the bolt recess 80 and bears against the wall of the bore 67 in the barrel 56 under the pressure of the bolt spring 140. The bag 22 may be locked again, after properly closing the slide fastener 32, as described above by turning the keeper arm 62 in the counterclockwise direction, with or without the key 54 in the lock. With the key in, the key is turned in the counterclockwise direction after the keeper arm 62 is turned, and the key is pulled out in the locking position. The lock bolt 134 under the pressure of its spring 140 then enters the bolt recess 80, to lock the parts together. With the key out, the lock bolt 134 snaps into the bolt recess 80 upon reaching the recess when the keeper arm 62 is turned.

While the keeper lock 20 has been described and illustrated as employed on a money bag 22, it may be employed with a variety of the other enclosing means or containers which employ slide fasteners as closure elements, for example, traveling cases, duffel bags, and tent flaps. While a preferred embodiment of the keeper lock of the invention has been described and illustrated, it will be apparent to those skilled in the art that various changes and modifications may be made therein within the spirit and scope of the invention. It is intended that such changes and modifications be included within the scope of the appended claims.

Having thus described the invention, what I claim as new and desire to secure by Letters Patent is:

1. In a keeper lock for a zipper-type slide fastener having a lacing element, said keeper lock including a barrel having a cylindrical bore and a laterally outwardly projecting rim flange on one end thereof, an anvil fixed to and projecting radially from the barrel and adapted for supporting a fastener lacing element thereon, a cylindrical handle rotatable in the barrel, a keeper arm fixed to and projecting radially from the handle for rotation therewith and adapted to overlie the anvil and a fastener lacing element thereon for retaining the lacing element between the keeper arm and the anvil to prevent operation of the fastener, said keeper arm having a flange extending laterally outwardly from the handle and overlying said rim flange, a lock cylinder rotatable in the handle, tumbler means movable between the lock cylinder and the handle for alternately preventing and enabling rotation of the lock cylinder relative to the handle, a lock bolt mounted in the handle and movable when the keeper arm overlies the anvil between a position locking the handle to the barrel and an unlocking position freeing the handle for rotation, and means coupling the lock cylinder and the lock bolt for moving the bolt between its said positions in response to rotation of the lock cylinder, the combination with means securing said handle substantial axial movement relative to said barrel, a lug integral with the undersurface of said keeper arm flange and with the outer surface of said handle, means defining an arcuate movement path for said lug including an arcuate recess formed in the wall of said barrel bore and bounded by said rim flange, said path being bounded by lug stops for limiting the rotation of said handle, whereby said handle and said keeper arm are limitedly rotatable upon movement of said lock bolt to its unlocking position between said position of the keeper arm overlying the anvil and an out-of-the-way position wherein the lacing element is accessible for manipulation, while each remains substantially in a constant axial disposition relative to said barrel, and means for automatically restoring said lock bolt to its locking position upon rotation of said handle and said keeper arm from said out-of-the-way position of the keeper arm to said anvil-overlying position.

2. A keeper lock for a zipper-type slide fastener having a lacing element, said keeper lock comprising, a barrel having a cylindrical bore and a laterally outwardly projecting rim flange on one end thereof, an anvil fixed to and projecting radially from said barrel and having a pocket formed thereon for supporting and retaining a fastener lacing element, a cylindrical handle rotatable in said barrel and having a cylindrical bore, means securing said handle against substantial axial movement relative to said barrel, a lug on said barrel, means defining an arcuate movement path for said lug including an arcuate recess formed in the wall of said barrel bore and bounded by said rim flange, said path being bounded by lug stops for limiting the rotation of said handle, a keeper arm fixed to and projecting radially from said handle for rotation therewith and adapted to overlie said anvil and a fastener lacing element thereon for retaining the lacing element between the keeper arm and the anvil to prevent operation of the fastener, said keeper arm having a flange extending laterally outwardly from the handle and overlying said rim flange, said lug being integral with the undersurface of said keeper arm flange and with the outer surface of said handle, said limitation of the rotation of the handle serving to limit the rotation of said keeper arm to rotate between its position overlying said anvil and an out-of-the-way position to one side of the anvil wherein the lacing element is accessible for manipulation, a cam undersurface on said keeper arm and engageable with a lacing element supported on said anvil during rotation of the keeper arm toward its position overlying the anvil for forcing the lacing element into said pocket, a lock cylinder rotatable in said handle, tumbler means movable between said lock cylinder and said handle for alternately preventing and enabling rotation of the lock cylinder relative to the handle, a lock bolt mounted in said handle and movable when said keeper arm overlies said anvil between a position locking the handle to said barrel and an unlocking position freeing the handle for rotation, means coupling said lock cylinder and said lock bolt for moving the bolt between its said positions in response to rotation of the lock cylinder, said handle and said keeper arm being adapted upon movement of said lock bolt to its unlocking position to rotate between said positions of the keeper arm while each remains substantially in a constant axial disposition relative to said barrel, and means for automatically restoring said lock bolt to its locking position upon rotation of said handle and said keeper arm from said out-of-the-way position of the keeper arm to said anvil-overlying position.

3. In a keeper lock for a zipper-type slide fastener having a lacing element, said keeper lock including a barrel having a cylindrical bore and a lock bolt recess in the wall of the bore and extending from one end of the barrel, a flange extending inwardly from the bore wall at said one end of the barrel and adjoining said lock bolt recess to define a keyhole-shaped opening in such end, and anvil fixed to and projecting radially from the barrel and adapted for supporting a fastener lacing element thereon, a cylindrical tubular handle rotatable in the barrel, a reduced diameter stem extending from the handle through said opening, a keeper arm fixed to and projecting radially from the handle for rotation therewith and adpated to overlie the anvil and a fastener lacing element thereon for retaining the lacing element between the keeper arm and the anvil to prevent operation of the fastener, a lock cylinder rotatable in the handle, tumbler means movable between the lock cylinder and the handle for alternately preventing and enabling rotation of the lock cylinder relative to the handle, a lock bolt mounted in the handle and movable when the keeper arm overlies the anvil between a position projecting into said lock bolt recess for locking the handle to the barrel and a non-projecting unlocking position freeing the handle for rotation, and means coupling the lock cylinder and the lock bolt for moving the bolt between its said positions in response to rotation of the lock cylinder, the combination with means securing said handle against substantial axial movement relative to said barrel including a member projecting from said stem for preventing movement of the stem through said opening, and also including a closure plate for said opening disposed between said projecting member and said flange and held in place thereby, said handle and said keeper arm being adapted upon movement of said lock bolt to its unlocking position to rotate between said position of the keeper arm overlying the anvil and an out-of-the-way position wherein the lacing element is accessible for manipulation, while each remains substantially in a constant axial disposition relative to said barrel.

4. A keeper lock for a zipper-type slide fastener having a lacing element, said keeper lock comprising, a barrel having a cylindrical bore and a lock bolt recess in the wall of the bore and extending from one end of the barrel, a flange extending inwardly from the bore wall at said one end of the barrel and adjoining said lock bolt recess to define a keyhole-shaped opening in such end, an anvil fixed to and projecting radially from said barrel and having a pocket formed thereon for supporting and retaining a fastener lacing element, a cylindrical handle rotatable in said barrel and having a cylindrical bore, a reduced diameter stem extending from said handle through said opening, means securing said handle against substantial axial movement relative to said barrel including a member projecting from said stem for preventing movement of the stem through said opening, and also including a closure plate for said opening disposed between said projecting member and said flange and held in place thereby, a lug on said handle, means defining an arcuate movement path for said lug in the wall of said barrel bore, said path being bounded by lug stops for limiting the rotation of said handle, a keeper arm fixed to and projecting radially from said handle for rotation therewith and adapted to overlie said anvil and a fastener lacing element thereon for retaining the lacing element between the keeper arm and the anvil to prevent operation of the fastener, said limitation of the rotation of the handle serving to limit the rotation of said keeper arm to rotation between its position overlying said anvil and an out-of-the-way position to one side of the anvil wherein the lacing element is accessible for manipulation, a cam undersurface on said keeper arm and engageable with a lacing element supported on said anvil during rotation of the keeper arm toward its position overlying the anvil for forcing the lacing element into said pocket, a lock cylinder rotatable in said handle, tumbler means movable between said lock cylinder and said handle for alternately preventing and enabling rotation of the lock cylinder relative to the handle, a lock bolt mounted in said handle and movable when said keeper arm overlies said anvil between a position projecting into said lock bolt recess for locking the handle to said barrel and a non-projecting unlocking position freeing the handle for rotation, and means coupling said lock cylinder and said lock bolt for moving the bolt between its said positions in response to rotation of the lock cylinder, said handle and said keeper arm being adpated upon movement of said lock bolt to its unlocking position to rotate between said positions of the keeper arm while each remains substantially in a constant axial disposition relative to said barrel.

* * * * *